United States Patent [19]

Simon

[11] Patent Number: 4,865,810

[45] Date of Patent: Sep. 12, 1989

[54] CENTRIFUGE FOR PERFORMING MEDICAL ANALYSES

[75] Inventor: Jean-Pierre Simon, Grenoble, France

[73] Assignee: Kis Photo Industrie, France

[21] Appl. No.: 99,238

[22] Filed: Sep. 21, 1987

[30] Foreign Application Priority Data

Sep. 25, 1986 [FR] France ..... 86 13550
Sep. 25, 1986 [FR] France ..... 86 13551
Sep. 25, 1986 [FR] France ..... 86 13552

[51] Int. Cl.[4] ..... G01N 35/00

[52] U.S. Cl. ..... 422/72; 436/45; 494/19

[58] Field of Search ..... 494/16, 19, 20; 422/72; 436/45

[56] References Cited

U.S. PATENT DOCUMENTS 2,762,635 10/1973 Hankey .
3,692,236 9/1972 Livshitz et al. .
3,800,161 3/1974 Scott et al. .
3,834,613 9/1974 Hankey .
3,848,796 11/1974 Bull ..... 494/19
3,882,716 5/1975 Beiman ..... 73/61.4
4,456,581 6/1984 Edelmann et al. .
4,632,908 12/1986 Schultz ..... 436/157
4,671,940 6/1987 Holen et al. ..... 422/72

FOREIGN PATENT DOCUMENTS 0137681 4/1985 European Pat. Off. .
0160901 11/1985 European Pat. Off. .
0195321 9/1986 European Pat. Off. .
2524874 10/1983 France .

OTHER PUBLICATIONS

Clinical Chemistry, vol. 31, No. 9, Sep. 1985, pp. 1457–1463.

*Primary Examiner*—Michael S. Marcus
*Assistant Examiner*—D. John Griffith, Jr.
*Attorney, Agent, or Firm*—Arnold, White & Durkee

[57] ABSTRACT

A centrifuge for performing biological and medical analyses for samples in test packs mounted in holders peripherally disposed on the centrifuge rotor. The test pack holders are also rotated relative to the rotor by means of a mechanical spinning portion fitted below the rotor. Analyses are made with a spectrophotometric measuring device, whose optical path is perpendicular to the plane of the rotor.

10 Claims, 11 Drawing Sheets

CENTRIFUGE FOR PERFORMING MEDICAL ANALYSES

BACKGROUND OF THE INVENTION

1. Field of Invention

The present invention relates to a centrifuge for performing analyses, particularly medical and biological analyses of samples contained in a test pack; this test pack includes, an optical cuvette for any spectrophotometric absorbance measurement.

2. Description of Related Art

Such centrifuge has been for example described in the patent application No. FR-A-2 524 874, and includes:

a rotor, driven in rotation by a motor means, comprising towards its periphery several individual holders for the various test packs, which themselves rotate relative to the rotor, means capable of spinning each individual holder relative to the rotor, in order to direct the centrifugal force relative to each test pack, a spectrophotometric measurement unit, the optical path of which is perpendicular to the plane of the rotor and oriented so as to pass through the optical cuvette of each test pack, in a pre-determined position of the latter in rotation.

In the framework of a centrifuge as described above, it is an object of the present invention to provide means capable of spinning the various test packs, and more precisely their various individual holders, meeting the following concerns:

not to increase the inertia of the rotor in considerable proportions so as to limit the power of the drive motor, and lighten the mechanical design of the whole system, not to resort to any individual means for rotation control of each individual test pack holder, such as a stepping motor, monitor the rotation of those same individual holders by a mechanical action initiated from a fixed part external to the rotor.

SUMMARY OF THE INVENTION

According to the present invention, the means capable of spinning each individual holder comprise:

a plate fixed relative to the rotor, fitted under the rotor, including a peripheral guide, a spinning portion, coplanar with the fixed plate, one of its ends being articulated on the fixed plate, the spinning portion including at least one guiding rail with a bending radius which coincides with that of the peripheral guide of the fixed plate, the spinning portion being movable between two positions, i.e. a first position where the guiding rail fits with the guide of the fixed plate, and a second position where the guiding rail fits with the free end of a projecting connection external to the fixed plate and linked to the peripheral guide, several spinning axes orthogonal to the rotor, assembled rotation-free on the rotor, on the upper end of which the various individual holders are mounted, and on the bottom end of which various rods are mounted, parallel to the fixed plate, each rod including at both ends coplanar rollers resting on the peripheral guide of the fixed plate.

As it will be described hereinafter, the characteristic means of the present invention are mechanically simple. So, the drive motor which rotates the rotor spins the test packs indirectly.

Furthermore, the means of this invention provide for the progressive and smooth spinning of the various test packs relative to the rotor. Thus, by avoiding any accelerated rotation of a test pack, all secondary centrifugation of the test pack relative to its own axis is avoided, which would damage the analysis quality.

BRIEF DESCRIPTION OF THE DRAWINGS

The method which may be used to perform this invention and the resulting advantages will appear more fully hereinafter, and for purposes of illustration, but not of limitation, an embodiment of the invention is shown in the accompanying drawings wherein.

DETAILED DESCRIPTION OF THE PREFERRED EMBODIMENTS

Figure 6:
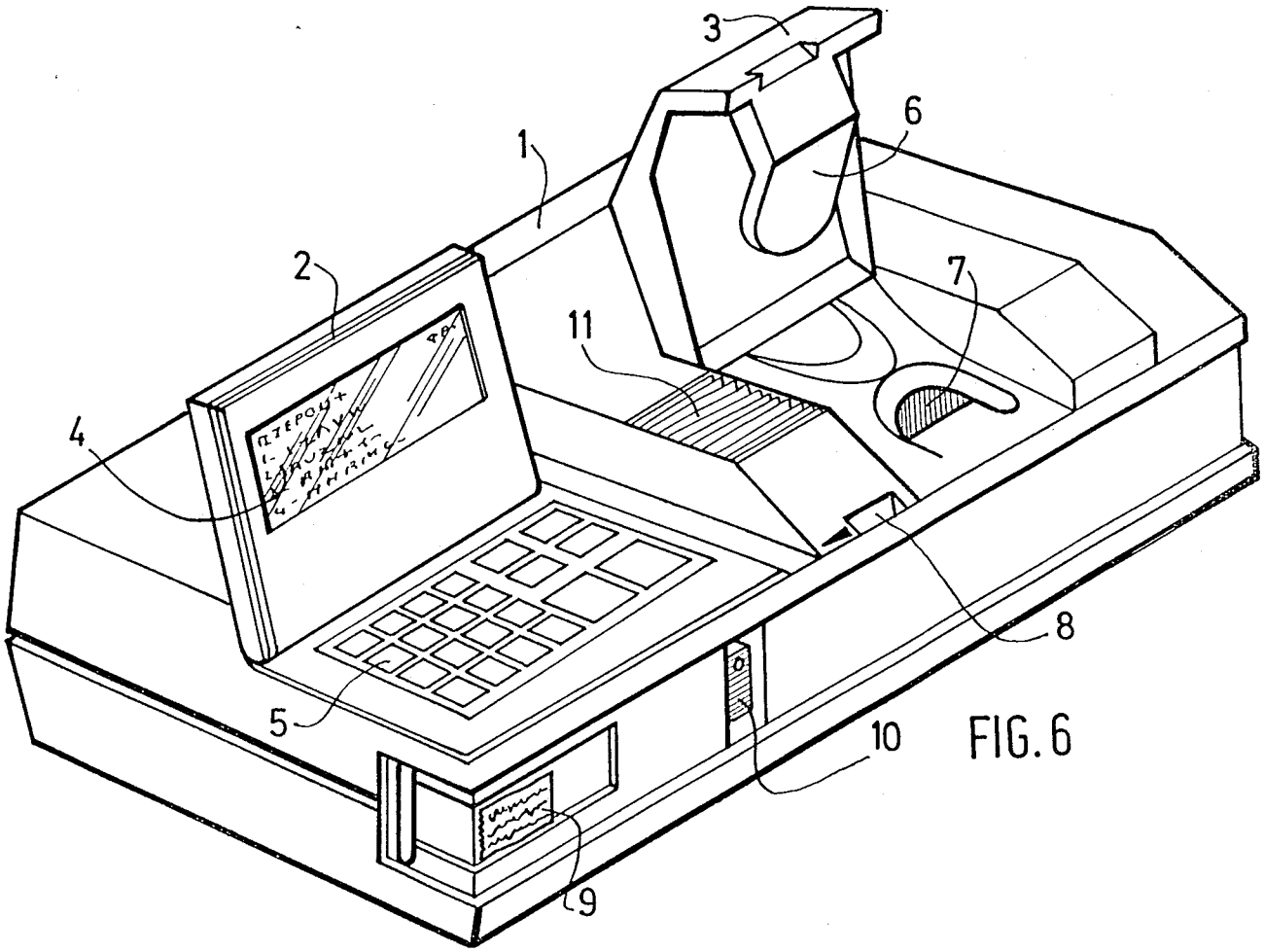
FIG. 6 is a drawing of the whole centrifuge according to the invention and incorporated within a housing.

The automatic centrifuge for performing biological and medical analyses pursuant to the invention is incorporated within a housing of a general parallelepipedic form illustrated by item 1 in FIG. 6. On the upper side of this housing, there are two lids respectively (2) and (3), one (2) used as a Liquid Crystal Display (4) and allowing access—when in an open position—to a touch sensitive keyboard (5), the other (3) allowing access to the various individual holders of the centrifuge which will be described hereinafter. This lid (3) allows access—when in an open position—to a semi-circular aperture used as access to the loading (7) of the test packs (50) on the upper rotary platter of the centrifuge. Furthermore, as will be described hereinafter, since the whole centrifuge is thermoregulated, the lid (3) is equipped with an air-tightness component (6) designed to perfectly fit into the access opening (7). The lids (2) and (3) can be locked by means of a locking knob (8).

The results of the analysis are printed by means of a printer (9) located very close to the liquid crystal display (4) and the keyboard (5). The whole centrifuge is monitored by a micro-processor with a PROM type software illustrated by item (10). On the upper side of the housing (1) there is also a flap (11) which allows for changing of the lamp of the optical system also described hereinafter.

Now, the centrifuge will be described more fully. It is composed first of all of a fixed bottom circular plate (12), interconnected with a stepping motor (13), and assembled by means of 4 screws and nuts, the inlet orifices (14) of which are illustrated. The motor (13) has a centering hump (15) which provides for a more precise positioning. The fixed plate (12) is suspended by 3 silent-bloc type absorbers, one of the straining points being illustrated by item (16). The fixed plate is further equipped with a peripheral rim or guide (17) designed to cooperate with the spinning components which will be also described hereinafter. The motor (13) is integral with an axis (18) on which three successive plates are fitted and mounted in the following order:

a supporting plate or rotor (19) attached onto the axis (18) by means of a cone-shaped insert (20), a locking plate (21), an upper plate (22) interconnecting—by means of nuts—said locking plate (21) to itself, i.e. to the upper plate (22) on the cone-shaped insert (20) of the rotor (19), and then on the rotary axis (18) of the motor (13).

The upper plate (22) is equipped with five receptacles (23), each designed to receive one test pack (50). Within the base (24) of each of said receptacles, there is firstly a slit (25) designed to cooperate with a part of the locking plate (21) and secondly a semi-cicular aperture (26) designed to cooperate with the spinning axis as described hereinafter. A circular plate (27) used as an individual holder of a test pack (50) has under its bottom side a mortise (28) designed to cooperate with a tenon (29) fitted on the upper end of a spinning axis (30). Furthermore, each holder (27) has two alignment posts (31) designed to cooperate with the alignment holes fitted within each test pack.

The rotor (19) has several orifices (32), each designed to leave a passageway for a spinning axis (30). Each of these orifices (32), located on the periphery of the rotor (19) is adjacent to two radial housings (33) which ascend from the center of the rotor to its periphery, each of these housings (33) being designed to receive a balancing ball (34). These balls (34) provide for dynamic self-balancing of the rotary unit of the centrifuge.

Figure 1:
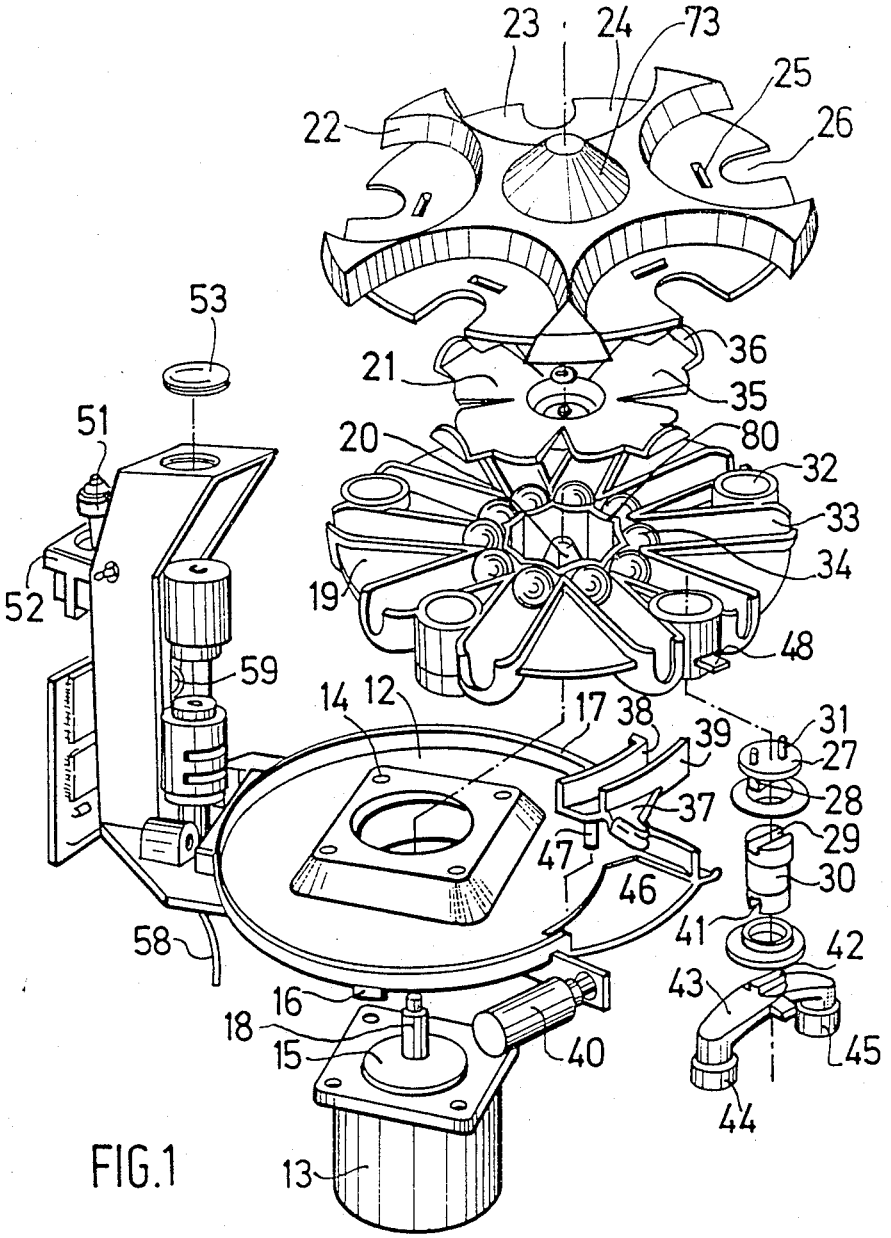
FIG. 1 is a perspective view partially exploded of an automatic centrifuge for performing medical and biological analyses pursuant to the invention.

The rotor comprises several pairs of housings (33), which ascend from the center to the periphery, each of these housings being radially aligned. In FIG. 1, there are five receptacles (23) and five pairs of housings (33). Each pair of housings (33) is positioned, close to the periphery of the rotor (19), on both sides of an orifice (32), providing a passageway for the axis (30) which spins the test packs (50) to be centrifuged within the receptacles (23) of the upper plate (22).

Each of the above housings (33) receives a ball (34) made of steel, the diameter of which depends on the mass of the desired ball. In FIG. 1, the housings ascend from the center to the periphery of the rotor (19), and the angle of inclination is 12 degrees (12°) relative to the horizontal so that when said rotor is not turning, the balls are located close to the center of said rotor (19), in contact with a crown (80) which limits the lower path of the balls, said crown surrounding the cone-shaped insert (20) mounted on the axis of the motor (13). On the other hand, when no component limits their ascending path, when the rotor (19) turns, said balls (34) are subjected to centrifugal force which, if the rotation speed is sufficient, causes the balls (34) to move up to the top of the housings (33). Therefore, the moments of centrifugal forces applied to the balls (34), relative to the central vertical axis of the motor (13), will only need to be higher than the moments of forces of gravity also applied to the ball, relative to same axis.

The locking plate (21) has the form of a corolla, and the number of its petals (35) is equal to the number of receptacles (23) of the upper plate (22), i.e., in FIG. 1, five. Each of these petals (35) or radial elements is equipped on its free end, with a pin or stop (36) extending toward the upper plate (22), and designed to cooperate with an opening (25), fitted within the base (24) of each of the receptacles (23) of said plate (22), and only in the event that the receptacle (23) in question does not contain any test pack (50) to be centrifuged. Moreover, each petal (35) is equipped on its bottom side, i.e. towards the rotor (19), with a stopper (81) or a retention means resulting from the molding, and located close to the base of the petal (35). The stopper (81) is designed to retain the ball (34) toward the crown (80) whenever the corresponding receptacle (23) receives a test pack to be centrifuged during the centrifugation steps.

Each of the petals (35) is subjected to a strain transmitted through the pin (36) whenever a receptacle (23) receives a test pack to be centrifuged, since the plate (21) is made of a flexible plastic material with elastic memory, and because of the molding it has a form so that it naturally tends to cause the pin (36) to cooperate with the slit (25) upwards. Thus, given the mobility of each petal (35) relative to an axis orthogonal to the rotation axis, any descending movement of the pin (36) leads to the accompanying descent of the stopper (81) which retains the balls (34). The two extreme positions of the plate (21) are respectively shown in FIGS. 10–13.

Thus, when one wishes to carry out the centrifugation of test packs (50), the latter shall be positioned within the receptales (23), by means of alignment posts (31), and the various centrifugation steps may be immediately started without any concern about balancing the system. In fact, since the mass of the test packs (50) to be centrifuged is known, the mass of the balancing balls (34) is adapted by using balls of a known diameter (the density of the balls remains constant, the only parameter which can vary the mass is the diameter), so that the sum of moments—relative to the axis of the motor (13)—of centrifugal forces applied to the balls (34) in the lower position and to the corresponding test pack (50) to be centrifuged, is equal to the moments—relative to same axis—of centrifugal forces applied to the ball in the upper position in a same pair of housings (33).

Thus, under the only effect of the centrifugal force generated by the rotation of plates, an automatic dynamic self-balancing is achieved. Moreover, it is quite possible to use only some of the receptacles (23) of the upper plate (22), without impairing balancing. In fact, when installing a test pack (50) to be centrifuged, the latter leans on the pin (36) which protrudes from the slit (25) of the base (24) thus causing the petal (35), and the stopper (81) to descend, resulting in the retention of the two corresponding balls (34) in the lower position. On the other hand, since empty receptacles do not cause the petals (35) of the plate (21) to descend, they do not prevent the balls from ascending to the top of the corresponding housings. At equal forces, the greater the radius of the circle described by the object on which said forces lean, the higher its moment relative to the axis passing through the center of said circle. Thus, it is possible, by previously calculating the mass of the balls (34) necessary to achieve the balance, to obtain a dynamic and automatic self-balancing mechanism.

Figure 14:
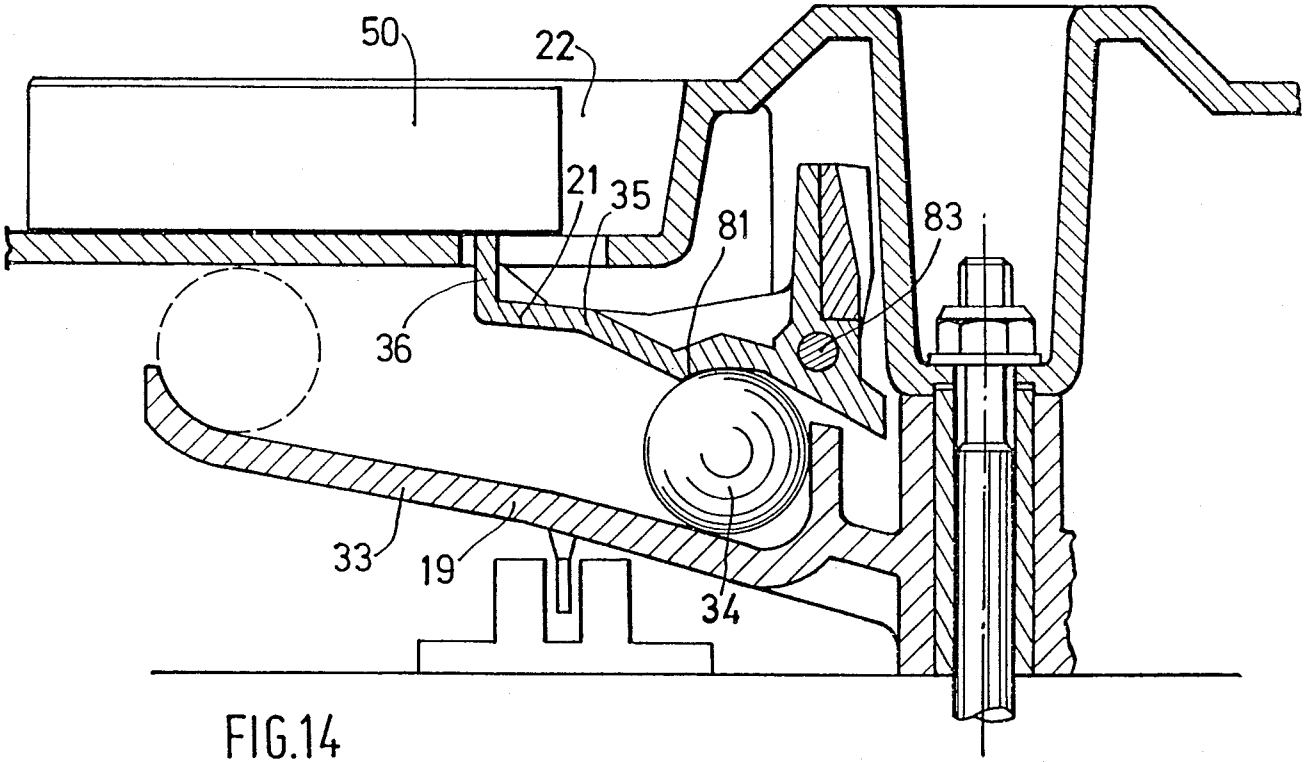
FIG. 14 illustrates, like in FIG. 3, another centrifugation system in accordance with the invention.

According to an alternative operation illustrated in FIG. 14, each petal (35) is individually articulated about an axis (83) orthogonal to the rotation axis, and spinning about the locking plate (21). Under these conditions, the lower rest position of a petal (35) is in contact with a ball (34). During the rotation of all of the plates, in the presence of a corresponding test pack (50) on the upper plate (22), the corresponding ball (34) cannot ascend again towards the upper end of the corresponding housing (33) which is blocked by the stopper (81); in the absence of a test pack (50), the pin (36) is not blocked from above, and the ball (34) pushes away the stopper (81) and the corresponding petal (35), and may reach the upper end of the housing (33).

This particular operating mode avoids the application of a biasing thrust to each test pack (50).

Now, the test pack spinning unit will be described more fully. The fixed plate (12) has close to its periphery and on a given sector, a portion called the "spinning portion" (37). This spinning portion (37) is equipped with two guiding rails (38) and (39), which are concentric and orthogonal to the plane of the fixed plate (12). When the spinning unit is not activated, the spinning portion (37) coplanar with said fixed plate (12) is integrated into this plate and defines a complete peripheral rim or guide (17), i.e. defining a perfect circle. The spinning unit is also equipped with an electro-magnet (40) designed to attract towards the outside of the fixed plate (12) said spinning portion (37) which is articulated about one of its ends in order to pivot in the plane of the fixed plate (12). Moreover, each of the above-mentioned spinning axes (30) is equipped on its bottom end with a tenon (41) designed to cooperate with a mortise (42) fitted on a rod (43) which is positioned parallel to the fixed plate (12); each rod (43) connects two coplanar and identical rollers (44) and (45), the rotation axis of which is parallel to the axis (30). These rollers (44) and (45), fitted respectively on both ends of a rod (43), come in contact with the peripheral rim (17) of the fixed plate (12) when the plates (19, 21 and 22) are in rotation. In fact, the rollers (44) and (45) of each spinning component are driven in rotation by the axis (30), which is itself driven by the orifices (32) fitted on the rotor (19).

The rails (38, 39) are spaced out by a gap which corresponds to the diameter of wheels (44, 45). The bending radius of the external guiding rail (39) has the same value as that of the peripheral rim (17) of the rotor (19) in order to form a complete peripheral rim when one does not wish to conduct a spinning step.

Figure 7:
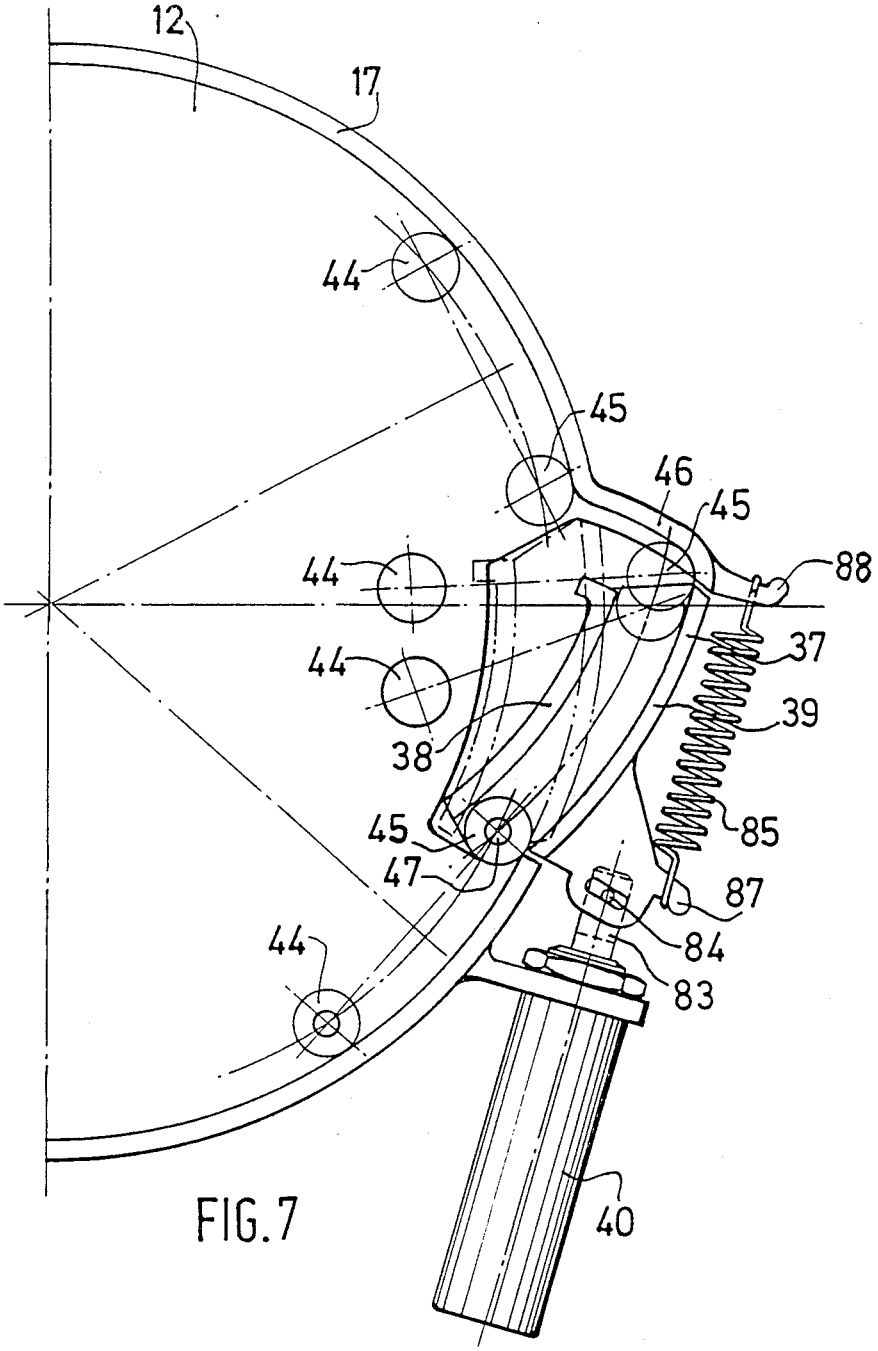
FIG. 7 is an enlarged top view of the spinning means in accordance with the invention.

The length of the internal guiding rail (38) is lower than that of the external guiding rail (39) by a value equal to the diameter of rollers (44, 45), apart from the variations of circumference, because the radius of circles on which the rails (38, 39) lean, do not have the same value, as shown more clearly in FIG. 7.

The border (46) is linked to the peripheral rim (17) of said plate (12) and is actually a simple extension of said rim (17) outside the fixed plate (12). Therefore, it has the same thickness and the same height as this rim (17). As will be described more fully hereinafter, the free end of the border (46) fits with one of the ends of the external guiding rail (39), i.e. The end opposite to the spinning axis (47) of the spinning portion (37), when said portion is activated. Furthermore, the free end of the connecting border (46) has a circular bend, the radius of which is equal to the radius of the rollers (44, 45), apart from the various thicknesses.

The centrifuge comprises a means suitable for causing the spinning portion (37) to pivot. In the embodiment described, this means is an electro-magnet (40) mounted on the fixed plate (12). This electro-magnet is advantageously controlled by a micro-processor in order to synchronize easily and rapidly the spinning or the non-spinning movement of the various rotation axes (30) included in the centrifuge. A magnetic core (83) slides in a conventional manner into the electro-magnet (40) body, and is attached about one of its ends onto a fixing lug (84) located on the spinning portion (37). Moreover, in order to provide for the return of the spinning portion (37) to its starting position when the action of the electro-magnet has ended, and in order to limit the travel of said portion when said electro-magnet is activated, the system is equipped with a spiral coiled spring (85), the straining points of which are respectively located on a lug (88), mounted on the free end of the connecting border (46), as well as on a lug (87) mounted close to the end of the spinning portion (37) located towards the pivoting axis (47).

Figure 8:
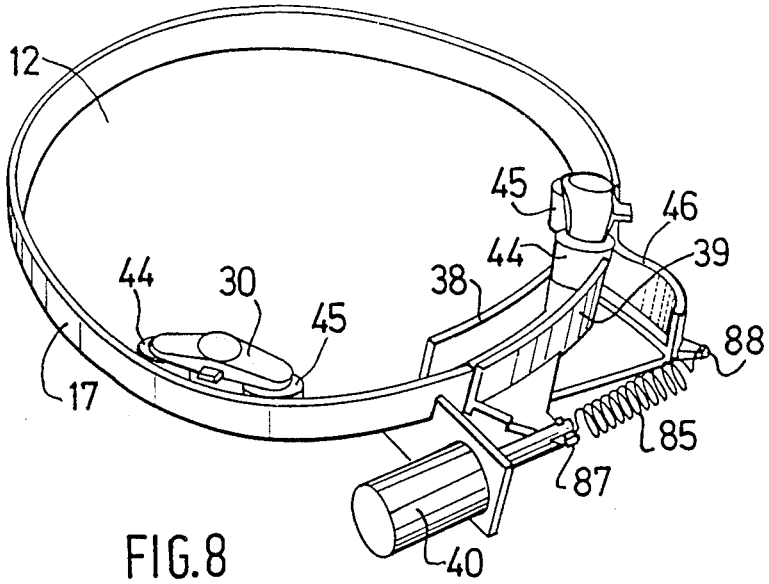
FIGS. 8 and 9 illustrate the operating mode of the spinning means shown in FIG. 7.
Figure 9:
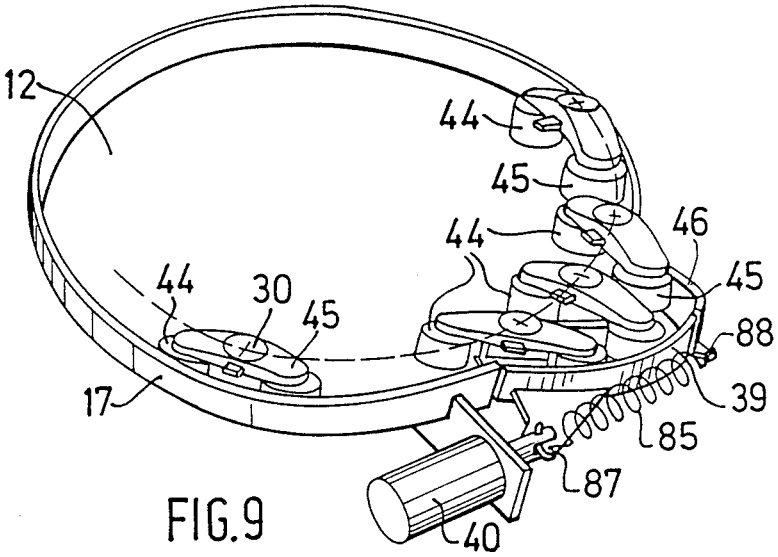
Figure 10:
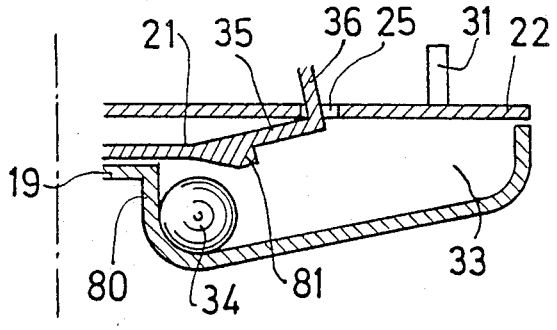
FIGS. 10 and 11 are sectional views illustrating the operation of a dynamic self-balancing mechanism pursuant to the invention, in the absence of a test pack to be centrifuged, respectively in stop phase and in centrifugation phase.
Figure 11:
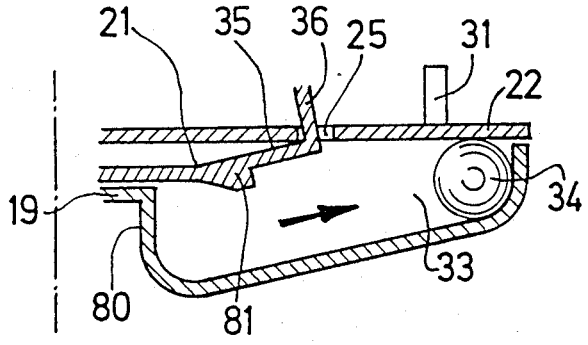
Figure 12:
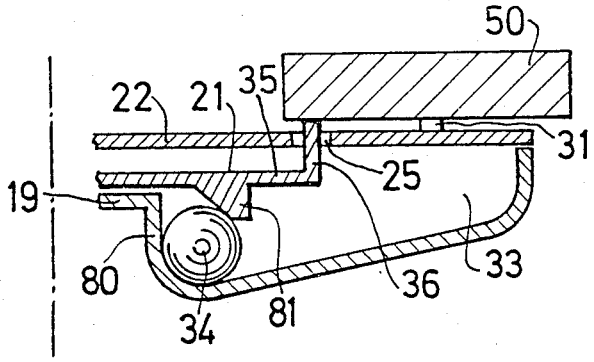
FIGS. 12 and 13 are sectional views illustrating the operation of same mechanism in the presence of a test pack to be centrifuged, respectively in stop phase and in centrifugation phase.
Figure 13:
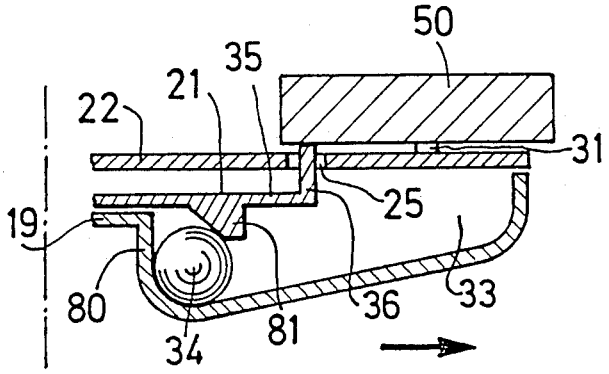

FIGS. 8 and 9 clearly illustrate the operating mode of the centrifuge pursuant to the invention. The spinning portion (37), when the electro-magnet is not activated, defines a complete peripheral circular rim (17) of the plate (12) and when said electro-magnet (40) is activated, provides, as will now be described, for the spinning of the axis (30) in question.

Since all of the axes (30) are in rotation, and activated by means of the rotor (19) which is integral with the motor (13), each of the two rollers (44, 45) of the axes (30) are in contact with the complete peripheral circular rim (17) of the plate (12). The axis (30) traces a constant circular path imposed by the rotor (19), the path being located close to said rim, in order to effect contact of said rollers (44, 45) with the rim (17). In fact, since the rod (43) which connects both rollers (44, 45) to the axis (30) is rigid, it imposes, as a result of the path of the axis (30), contact of both rollers with the rim (17).

When one wishes to cause a one hundred and eighty degree (180°) spin of one or several moving bodies (30), one activates the electro-magnet (40) which attracts the spinning portion (37), by rotation of the latter about its own pivoting axis (47). Thus, the front roller (45), as a result of the rotation of the axis or axes (30) enters the guiding path defined by the two rails (38, 39). Given that the spinning portion (37) is in a position spaced relative to its starting position, the roller (45) deviates from its circular path, causing the separation of the rear roller (44) from the rim (17), and towards the inside of the fixed plate (12), as a result of the constant circular path of the axis (30) and the rigidity of the rod (43). The path of the rear roller (44) is imposed by the rotation of the rod (43) about the spinning axis (30), the rotation itself being imposed by the path traced by the front roller (45).

As the axis (30) follows its constant circular path, the roller (44) follows its own path inside the plate (12) and joins the peripheral circular rim (17) before the roller (45) has ended its path within the spinning portion (37).

It is important to emphasize that, when introducing the front roller (45) into the spinning portion (37), the angular velocity is null. Then, as a result of the external separation of said portion, and of the constant rotation of the axis or axes (30), the angular spinning velocity increases up to a maximum value reached when said roller (45) arrives at the end of the path of the guiding rail (38, 39), the linear velocity of the rear roller (44) being then also maximum.

When the roller (44) passes in front of the roller (45), the angular spinning velocity decreases until the roller (44) reaches the rim (17) together with the return of the roller (45) along said rim, since said roller (45) has just finished its path along the connecting border (46). Then, the angular spinning velocity becomes null again, and the 180 degree spinning has ended. If only one axis (30) is to be spinned, the electro-magnet should be deactivated to provide, through the action of the biasing spring (85), for the return of the spinning portion (37) to its starting position, i.e. The position which defines a complete peripheral circular rim. On the other hand, if all of the axes (30) are to be spinned, the electro-magnet should be activated during a period of time corresponding to one revolution of the rotor.

It has to be noted that, in the described example, the rotor (19) should turn counterclockwise (i.e. in the trigonometric direction), so that the front roller (45) of each of the axes (30) enters the proper side of the spinning portion (37). But it is quite obvious that it could also turn clockwise with an enantiometric shape (optical antipode) of the spinning portion (37).

Figure 5:
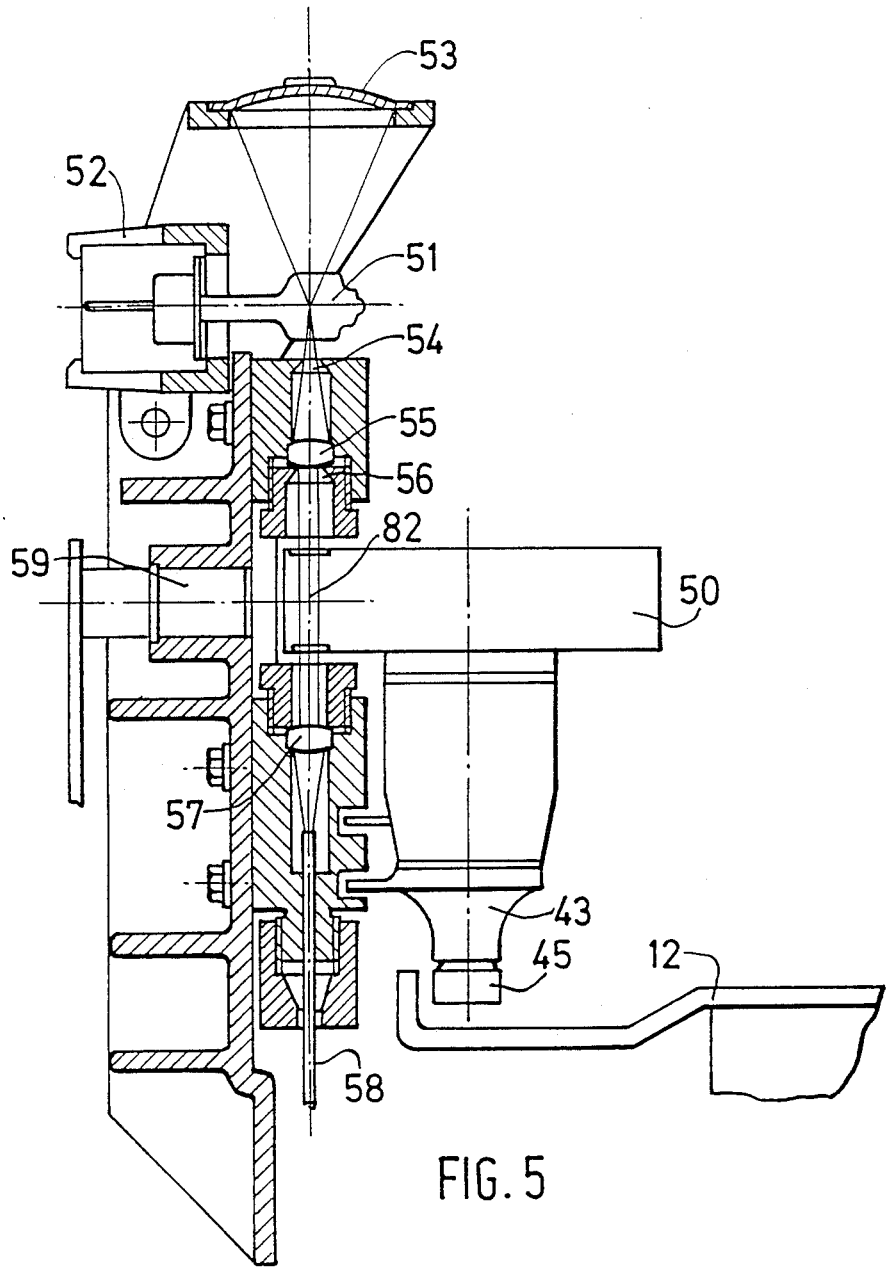
FIG. 5 is a sectional view of the optical system, which is part of the spectrophotometric measurement unit.

The test packs (50) (see FIG. 5) comprise, as is well known, a reagent chamber, a sample chamber and an optical cuvette (82) with at least two optical parallel walls. They are bound up on each individual holder (27) by means of alignment posts (31). They are subjected to a 180 degree spinning by means of the spinning axis (30), in order to provide for the inversion of the centrifugal force which is applied to them, same centrifugal force being designed to transfer the liquids, since capillary ducts are used to interconnect the various chambers within the test pack (50). It has to be noted that each of the test packs (50) bears on one of its walls a barcode indicating the analysis parameter used and the expiration date of same test pack.

Now, the optical system will be described more fully, which provides, apart from the barcode reading, for the spectrophotometric absorbance analysis of the result of the reaction between the reagent and the sample present in same test pack (50).

A part of this optical system is mounted on the border of the fixed plate (12) on the opposite side of the spinning portion (37). This optical system (see FIG. 5) comprises a lamp (51) mounted on a 90° pivoting plate (52) to facilitate changing of the lamp through the flap (11). When it is in operating position, the lamp (51) is topped by a spherical mirror (53) designed to focus on a first diaphragm (54) the light beam which it receives. The diaphragm (54) is succeeded by a lens (55) designed to form a parallel beam of the light derived from the diaphragm (54). This parallel beam is then calibrated by means of a second diaphragm (56) and sent through the optical cuvette (82) of the test packs (50). In fact, the optical system is designed such that it leaves a gap corresponding to the thickness of the test pack (50). The light beam transmitted by the optical cuvettes of test packs (50) is focused by means of a convergent lens (57) on the end of a silica single-strand optical fiber designed to transmit the light beam to the optical analysis system.

On the other hand, a reading barcode cell (59) fitted within the optical unit previously described, and facing one of the walls of the test packs (50) is located close to same wall when the test pack is positioned in the gap separating the diaphragm (56) from the convergent lens (57). This reading barcode cell (59) is connected to an electronic board with deciphers the barcode to check the parameter used in the test packs, the lot number, and the expiration date. This first part of the optical system is shown more fully in FIG. 5.

Figure 2:
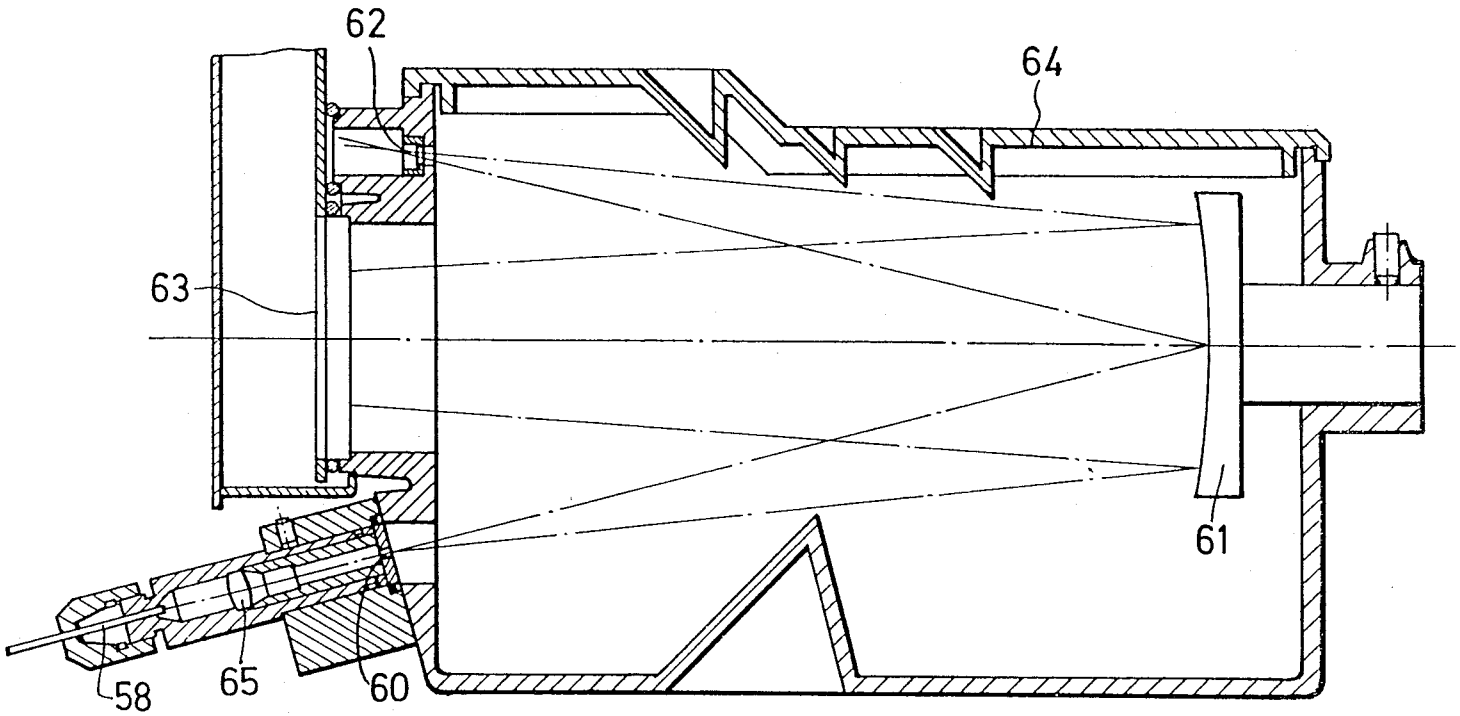
FIG. 2 is a sectional view of the spectrophotometer with its flat-field holographic diffraction grating which is part of the centrifuge shown in FIG. 1.
Figure 3:
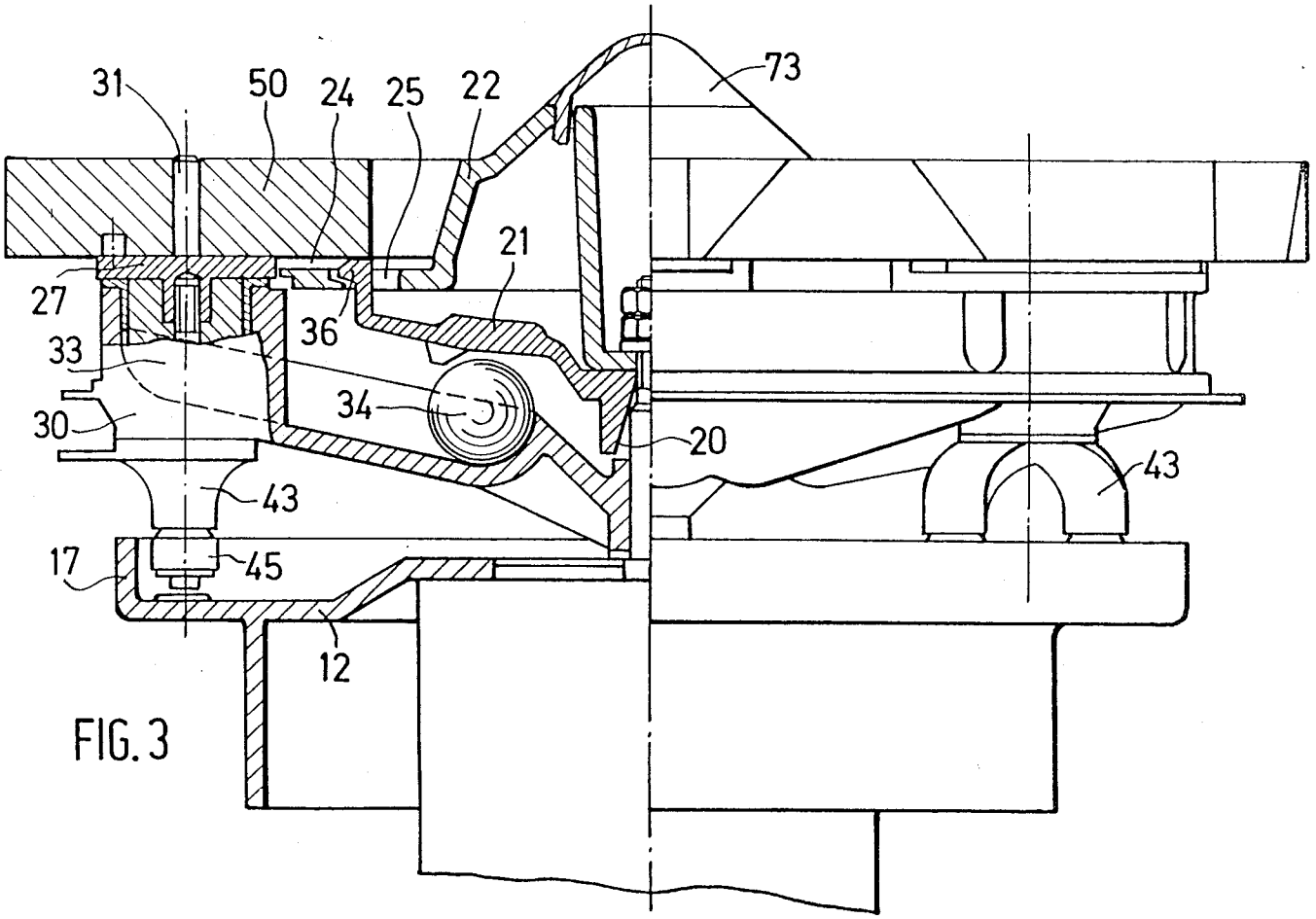
FIG. 3 is a sectional view of the centrifugation system pursuant to the invention.

The optical analysis system is shown more fully in FIG. 2. The other end of the optical fiber (58) is located close to a second set of optical elements which forms the optical analysis system. The light beam transmitted by the optical fiber (58) is focused by means of a convergent lens (65) on a calibrated diaphragm (60). The latter provides for the conveying of the light beam on a flat-field holographic diffraction grating (61) which, as is well known, diffracts:

the complete spectrum of the light source conventionally called "0" (zero) order, various spectra of the light source diffracted according to well-known angles; these spectra are conventionally called orders 1, −1, 2, −2, etc., in the order of their lower transmission.

As far as the present invention is concerned, only the orders zero and −1 are analyzed.

First of all, a cell (62) provides for a zero order measurement of the whole light, in order to inspect the variations of the lamp (51). At the same time, the intensity of some lines centered on specific wavelengths is analyzed in the order −1 by means of an array of photodiodes (63), practically facing the holographic diffraction grating (61). The features of photodiodes are predetermined. The unit formed by the holographic grating (61), the arrays of photodiodes (63) and the second optical unit are inserted in the housing (64) away from light and dust. The contacts coming out of the photodiodes (63) are connected to electronic boards in a conventional manner, and evaluated by means of a microprocessor hereabove mentioned.

Figure 4:
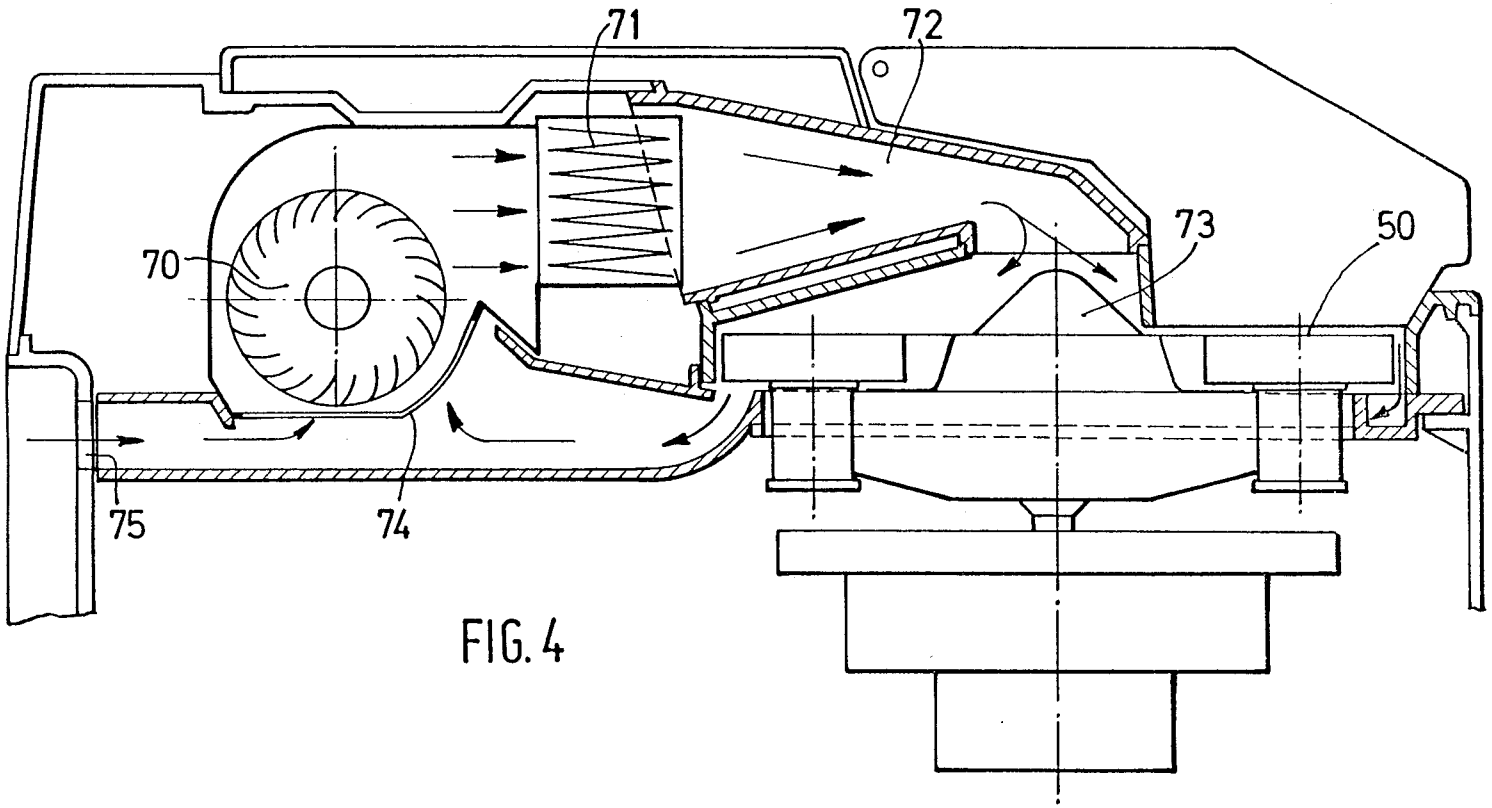
FIG. 4 is a sectional view of the centrifuge, particularly illustrating the thermoregulation and ventilation system.

The thermoregulation unit illustrated in FIG. 4, comprises first of all a fan (70) which pulses the air through the heating elements (71), out of which the pulsed air is guided by means of a heat flow guide (72) onto the centrifuge. The upper plate of the latter has in its center a dome (73) designed to distribute the heat flow onto all of the test packs (50). Given the presence of the lid (3) and of the air-tightness component (6), the hot air is recycled and re-sucked through a channel (74) located under the fan (70).

There is, however, a cool air inlet (75) to compensate for the slight leakages always existing in these systems. This source (75) of cool air is fitted on the backside of the housing (1) of the analyzer.

The whole centrifuge, as has been already mentioned, is controlled by a micro-processor which monitors the various steps of centrifugation, rotation, thermoregulation and optical analysis. This micro-processor is run by means of the touch sensitive keyboard (5).

I claim:

1. A centrifuge for performing analyses, in particular medical and biological analyses of samples contained in a test pack which comprises an optical cuvette for spectrophotometric absorbance measurement, the centrifuge comprising:

a rotor driven in rotation by a motor means, the rotor having on a periphery thereof several individual holders for the various test packs which themselves rotate relative to the rotor, means for holding and spinning said holders, causing each individual holder to spin relative to the rotor, in order to direct centrifugal force relative to each test pack, a spectrophotometric measurement unit, the optical path of which is perpendicular to the plane of the rotor, oriented so as to pass through the optical cuvette of each test pack, in a pre-determined position of each test pack in rotation, said holding and spinning means comprising:

a plate fixed relative to the rotor, fitted under said rotor, including a peripheral guide and having a projecting connection external to the fixed plate and linked to the peripheral guide, a spinning portion, coplanar with the fixed plate, one end of said spinning portion being articulated about said fixed plate including at least one guiding rail with a bending radius which coincides with that of the peripheral guide of the fixed plate, the spinning portion being movable between a first position, where the guiding rail fits with the peripheral guide of the fixed plate, and a second position, where the guiding rail fits with the free end of said a projecting connection, several spinning axes orthogonal to the rotor, mounted rotation-free on the rotor, on the upper ends of which said individual holders are fitted, and on the bottom ends of which rods are mounted parallel to the fixed plate, each rod including at its ends two coplanar rollers which abut the peripheral guide of the fixed plate, means to move the spinning portion between said first and second positions.

2. A centrifuge as claimed in claim 1 wherein the free end of the external projecting connection has a bend that is equal to the bend of the rollers.

3. A centrifuge as claimed in claim 1, further comprising an upper plate, integral in rotation with the rotor, positioned parallel and above said rotor, said upper plate comprising at a periphery thereof several receptacles for the various test packs, an aperture being formed in each receptacle in which one of said spinning axes is positioned, said spinning axes spinning each individual holder.

4. A centrifuge as claimed in claim 1, wherein dynamic balancing means are associated with the rotor, and comprise:

on the rotor several radial housings associated with said individual holders, each radial housing ascending from a center of said rotor to the periphery of said rotor, as well as several balancing balls respectively received in the radial housings, a locking plate fitted parallel to the rotor, integral in rotation with said rotor, said locking plate including several radial elements, each moving relative to an axis orthogonal to the rotation axis, each radial element including opposite to the rotor a pin which is pushed downward when a test pack loaded with a sample is placed on said pin, each radial element further including on a side facing the rotor, a stopper means which, when said pin is pushed downward, retains at least one corresponding balancing ball in a portion of said radial housing adjacent said center of the rotor.

5. A centrifuge as claimed in claim 4, wherein said radial housings have a slope relative to a horizontal line of between ten and fifteen degrees.

6. A centrifuge as claimed in claim 4, wherein the locking plate has the form of a corolla having petal-shaped portions, said petal-shaped portions merging with the radial elements.

7. A centrifuge as claimed in claim 4, wherein a pair of ascending housings and balancing balls corresponding to each individual holder are positioned on said rotor.

8. A centrifuge as claimed in claim 7, wherein housings which form a pair are fitted on both sides of an orifice, means for spinning said holder about an axis of said holder being positioned in said orifice, said means comprising one of said spinning axes.

9. A centrifuge as claimed in claim 4, further comprising an upper plate, integral in rotation with the rotor positioned parallel and above said rotor, said upper plate comprising at a periphery thereof several receptacles for the various test packs, an aperature being formed in each receptacle in which one of said spinning axes is positioned, said spinning axes spinning each individual holder.

10. A centrifuge as claimed in claim 9, wherein the locking plate is positioned between the rotor and the upper plate, and said pins project through slits in the various receptacles when said pins are not being pushed downward by test packs.

* * * * *